United States Patent [19]

Shinsako

[11] 4,179,145

[45] Dec. 18, 1979

[54] SANITARY DOG LITTER BAGGER

[76] Inventor: Joe H. Shinsako, 171 W. 79th St., New York, N.Y. 10024

[21] Appl. No.: 933,862

[22] Filed: Aug. 15, 1978

[51] Int. Cl.[2] ..... A01K 29/00

[52] U.S. Cl. ..... 294/19 R; 294/1 R; 294/115

[58] Field of Search ..... 294/1 R, 19 R, 50.8, 294/55, 100, 115, 116

[56] References Cited

U.S. PATENT DOCUMENTS

| | | | |
|---|---|---|---|
| 3,446,525 | 5/1969 | Jones | 294/19 R |
| 3,733,098 | 5/1973 | Tobias | 294/19 R |
| 3,738,697 | 6/1973 | Kahan | 294/19 R |
| 3,841,686 | 10/1974 | Gallo et al. | 294/19 R |
| 4,014,584 | 3/1977 | Bau | 294/19R |
| 4,097,082 | 6/1978 | Orofino | 294/19 R |

*Primary Examiner*—Johnny D. Cherry
*Attorney, Agent, or Firm*—Kirschstein, Kirschstein Ottinger & Cobrin

[57] ABSTRACT

A manually operated portable device for scooping dog feces into a bag by the action of a pair of opposed scoops which depend from a generally rectilinear support member having a barrel and an inner sleeve. A handle is provided at the upper end of the rectilinear member, and the handle is attached to the sleeve. The handle is displaceable away from the barrel and subsequently partially rotatable, so that the pair of scoops are displaced away from each other, and the scoop end of the device is thus opened so that a bag which is mounted upside down on the scoops may receive the dog feces. The bag is held in place because the open half of the bag is turned inside-out over the outer surface of the scoops. Thereafter, the scoops are snapped shut by reverse partial rotation of the handle and subsequent displacement of the handle towards the barrel, because of the urging of a stressed elastic member such as a spring which extends between the handle and an axle at the lower end of the barrel. Thus, the dog feces is effectively removed into the bag.

9 Claims, 11 Drawing Figures

FIG. 6
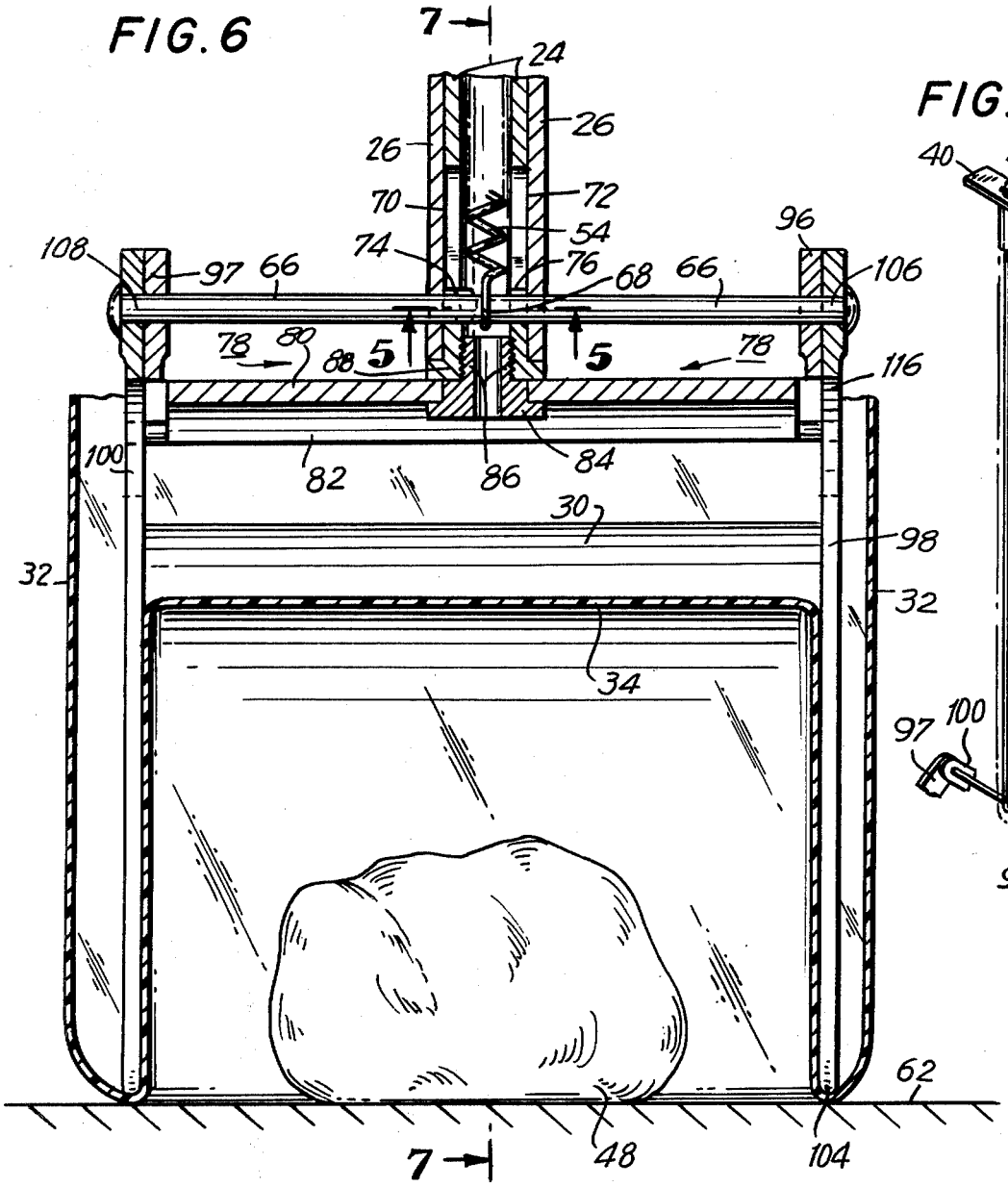
FIG. 11
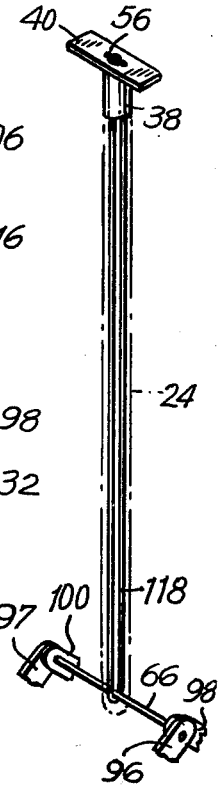
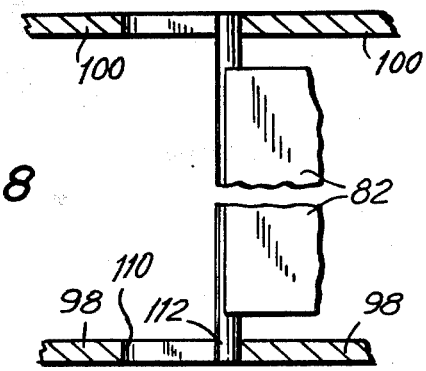
FIG. 8
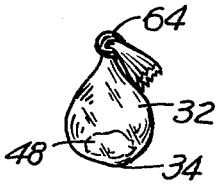
FIG. 10

SANITARY DOG LITTER BAGGER

BACKGROUND OF THE INVENTION

1. Field of the invention

A device for manually removing deposited dog feces from a surface.

2. Description of the Prior Art

The problem of dog feces deposited on sidewalks, walkways, in parks, etc., is ubiquitous, especially in urban areas. Although most cities and municipalities have adopted ordinances requiring the dog owner to curb his dog, this law is seldom observed in many areas and enforcement of the law is difficult since law enforcement officers are, in many instances, devoting their time to more serious crimes. Thus, deposited dog feces is prevalent in many urban areas. Besides being unsightly and unsanitary, typically soiling the shoes of unwary pedestrians, deposited dog feces is a serious health hazard to small children who often play with and even ingest the dog feces due to natural instinct and curiosity, thinking that it is food. This can lead to serious illness in the child such as worms or digestive upsets.

Other instances where a small, portable manual scoop is usable include diverse occupations such as park department employees, e.g. persons assigned to removal of leaves and small twigs from the ground, factory workers, homeowners, military personnel assigned to policing an area such as in the vicinity of the barracks, etc.

With specific regard to dog drop scoops per se, a body of prior art has been developed in recent years because of the need for an inexpensive, workable device to accomplish the elimination of dog droppings, i.e. dog feces, from the urban environment, and also in response to the more stringent laws relative to pollution which have been enacted in recent years. The urging of environmentalists in this regard is well known, and there is a continuing debate between such groups and those who have dogs as pets or for security reasons, i.e. as protection against intrusion in the dwelling by criminals intent on burglary, robbery or even rape or murder. This is especially true in certain urban areas, where the vast majority of perceptive people keep one or more guard dogs in their dwellings. This consideration, in recent years, has also become more prevalent in the suburbs and even in rural areas where the crime rates are constantly rising.

Among the many prior art patents relating to the highly developed art of dog drop scoops may be mentioned U.S. Pat. Nos. 3,716,263; 3,733,098; 3,786,780; 3,819,220; 3,841,686; 3,912,316; 4,010,970 and 4,014,584.

Another prior art approach to the problem of dog feces entails the provision of a harness or framework including a plastic bag, which is mounted over the anal region of a small animal, such as a dog, so that when the animal has a bowel movement and defecates, the feces is caught in the bag which is disposable. Prior art relative to this approach to the solution of the problem of dog feces includes U.S. Pat. Nos. 3,656,459; 3,786,787; 3,792,687; 3,817,217 and 3,875,903.

SUMMARY OF THE INVENTION

Purposes of the Invention

It is an object of the present invention to provide an improved sanitary dog litter bagger.

Another object is to provide an improved dog drop scoop.

A further object is to provide an improved device for removing deposited dog feces from a surface.

An additional object is to provide an improved manual portable scoop for removing an object or objects from a surface.

Still another object is to provide a two-position scoop which is manually adjustable into either an open disposition to receive objects such as dog feces, in which case, a small flexible bag composed of plastic, paper, cloth or the like will be mounted mouth down on the scoop end of the device, or a closed disposition with the opposed scoops snapped shut for retention of the object or objects, such as dog feces, in the bag.

Still a further object is to provide an inexpensive, reliable and sturdy device for removing an object or objects such as dog feces from a surface.

These and other objects and advantages of the present invention will become evident from the description which follows.

Brief Description of the Invention

In the present invention, the improved sanitary manual scoop and dog litter bagger is generally characterized by the provision of several salient structural elements in combination. A hollow rectilinear barrel or shank extends from a partially rotatable member to the scoop or working end of the device, i.e. the partially rotatable member is mounted at one end of the barrel. The partially rotatable member has a hollow rectilinear leg and a handle, the latter element being provided for the manual grasping and manipulation of the device. The hollow rectilinear leg is partially rotatable about its longitudinal axis. The handle extends generally transverse to the leg and is attached to the terminal end of the leg. The barrel and the leg are coaxially aligned in tandem and abutting. The device in its broadest embodiment also includes a sleeve; one end of the sleeve is attached to the end of the leg which abuts the barrel. The sleeve extends coaxially within the barrel from this attachment. The outer surface of the sleeve is contiguous with the inner surface of the barrel, so that the sleeve is slidably displaceable both longitudinally and partially rotatably within the barrel. An axle is also provided, which axle is mounted to the barrel adjacent to the other end of the barrel and extends generally transversely through the barrel and the sleeve. The other end of the sleeve extends beyond the other end of the barrel. A generally rectilinear resilient elastic member such as spring or an elastomeric rubber band extends within the sleeve and the leg. Means are provided to attach one end of the elastic member to the axle, and means are provided to attach the other end of the elastic member to the handle. The sleeve has a pair of opposed longitudinal slots adjacent its other end, and the axle extends through the slots. The end of each of the slots which is juxtaposed with the other end of the sleeve has a lateral extension, so that sleeve retention recesses are defined by the lateral extensions. This latter configuration contemplates that when the elastic member is elongated by longitudinal displacement of the partially rotatable member away from the barrel and subsequent partial rotation of the partially rotatable member, with concomitant partial rotation of the sleeve, then the axle extends into the recesses and retains the sleeve in a displaced position with concomitant opening of the scoop members away from each other so that the dog feces is receivable in the bag. A rectangular planar baffle is centrally mounted to the other end of the sleeve, so that the sleeve is generally perpendicular to the planar baffle. A pair of opposed scoops is provided. Opposed lateral means are provided to mount each of the scoops to both adjacent corners of the planar baffle and pivotally to the ends of the axle, so twat when the partially rotatable member is displaced away from the barrel as described supra, the free ends of the scoops are retracted away from each other, a deformable flexible open-mouthed bag composed of plastic, paper, cloth or the like being then mountable on the scoops, with the bottom of the bag adjacent to the planar baffle, so that when the barrel and the leg of the partially rotatable member are abutting, the free ends of the scoops are juxtaposed.

The various structural members of the present device, with the exclusion of the elastic member, may be composed of paperboard, plastic, sheet metal, wood or the like; the axle will usually be composed of metal such as a steel or aluminum rod or tube. The elastic member, if a spring, will usually be a steel coil spring.

In a preferred embodiment, the barrel and the sleeve are cylindrical, and the barrel is concentrically disposed about the sleeve. In most instances, the handle will be rectilinear. Typically, the means attaching the one end of the elastic member to the axle entails a looping of the one end of the elastic member about the axle at generally the middle of the axle. Typically, the means attaching the other end of the elastic member to the handle comprises a pin, the handle having a central opening, with the pin being mounted to the handle across the opening, together with a looping of the other end of the elastic member about the pin.

It is preferred that the lateral means mounting each of the scoops to the adjacent corners of the planar baffle and pivotally to the ends of the axle entails the provision of opposed curved levers, each scoop having a laterally attached level along each side edge, so that a portion of each level is integral with its respective scoop. The balance of each lever then extends to the aforementioned pivotal mounting to an end of the axle and being slotted adjacent its respective scoop, with a protuberance extending from each of the adjacent corners of each scoop into the respective slot in a lever. In this embodiment of the invention, preferably the portion of each lever between the slot in the lever and the pivotal mounting of the end of the lever to the end of the axle is generally rectilinear.

The device of the present invention provides several salient advantages. The elimination of dog feces from the urban environment has a salutary effect on the appearance and sanitary conditions in the public areas, as well as preventing soiling of shoes and even preventing disease among small children. The present device is inexpensive, rugged, serviceable, portable, and is manually operated and manipulated by young and old alike. Thus, the present device serves to aid in alleviating and arresting the highly prevalent urban decay which is due in some measure to the appearance of certain urban areas, i.e. litter, trash and other objects as well as dog feces may be removed from the urban areas, thus improving the cleanliness and appearance of even the worst slum areas. The present device is reliable and sturdy in service. The present device is a two-position scoop in which the scoop is retained in either an open or shut configuration until manipulated by the operator, i.e. once the dog feces is in the bag, the scoop elements are snapped shut and remain closed until the laden bag may be safely and cleanly disposed of, while the scoop also remains in the open position without stress or strain on the part of the operator when once adjusted. In other words, a two-position scoop is provided which is normally adjustable into either an open disposition to receive objects such as dog feces, in which case a small flexible bag composed of sheet or film plastic, paper, cloth or the like will be mounted mouth-down on the scoop end of the device, or a closed disposition with the opposed scoops snapped shut for retention of the object or objects, such as dog feces, leaves, twigs, trash, litter, etc., in the bag.

The advantages of the present device for the consumer include positive action with a minimum number of parts, for simple operation and longevity of product; appealing, clean design to enhance marketing and sales, and the fact that the device may use recycled polyethylene produce bags derived from a supermarket. Typically, a complimentary package of bags will be enclosed with the product, and additional bags can be offered at a nominal cost, such as one cent each. The polyethylene bags are the same as manufactured for supermarket produce departments, and each bag can have the name of a product or a message and/or advertising material printed on it. The use of the same type of bags from the same manufacturer who supplies supermarkets is a very feasible utility for such bags; this consideration also applies to the ability to recycle used produce bags, as mentioned supra. For those who wish to buy additional bags, a package or roll could be made available at nominal cost, and one of such packages or rolls could be included in the carton containing the device as sold. An advantage of the device for the manufacturer of same is that it is designed for ease of production and assembly.

The invention accordingly consists in the features of construction, combination of elements, and arrangement of parts which will be exemplified in the device hereinafter described and of which the scope of application will be indicated in the appended claims.

BRIEF DESCRIPTION OF THE DRAWINGS

In the accompanying drawings in which is shown one of the various possible embodiments of the invention:

FIG. 6 is a partial sectional elevation view taken substantially along the line 6—6 of FIG. 1;

FIG. 8 is a partial sectional angular view taken substantially along the line 8—8 of FIG. 7;

FIG. 10 shows the final disposition of the dog feces in the bag and ready for ultimate disposal; and FIG. 11 is a perspective view showing an embodiment in which the generally rectilinear resilient elastic member consists of an elastomeric rubber band.

DETAILED DESCRIPTION OF THE PREFERRED EMBODIMENTS

Figure 1:
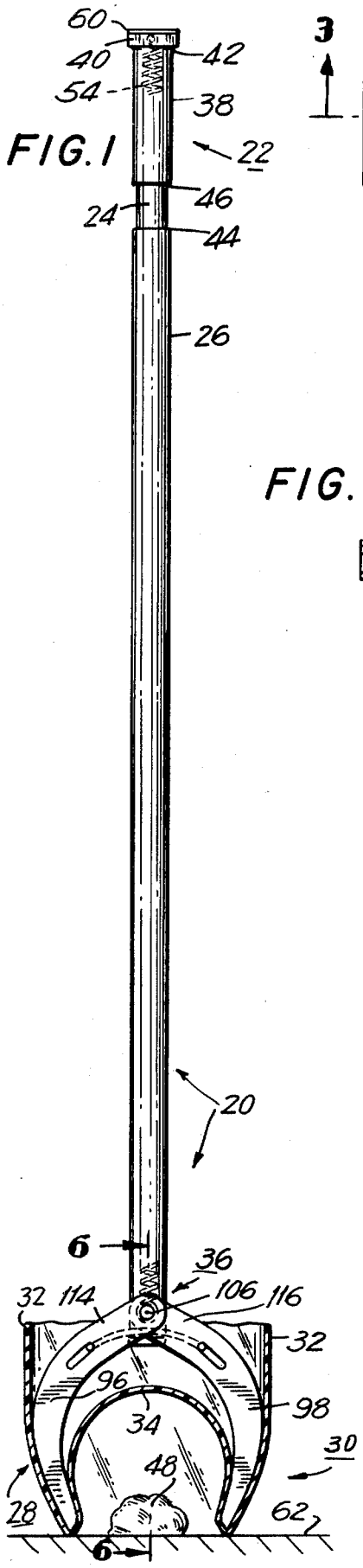
FIG. 1 is an elevation view of the device with the scoop elements spaced apart, i.e. the scoop is open and disposed about a deposit of dog feces.

Referring now to FIG. 1, the device, generally designated as 20, includes an upper partially rotatable member 22, a sleeve 24, a barrel 26 and a pair of opposed scoops 28 and 30. A bag 32 is mounted to the pair of scoops 28 and 30; the particular mode of mounting the bag 32 which may be adopted may vary, in this case the disposition of the bag 32 is with the bottom 34 of the bag 32 extending within the scoops or jaws 28 and 30 immediately adjacent the upper pivoted junction 36 of the scoop 28, from which junction 36 the bifurcated scoop means depends downward.

Figure 9:
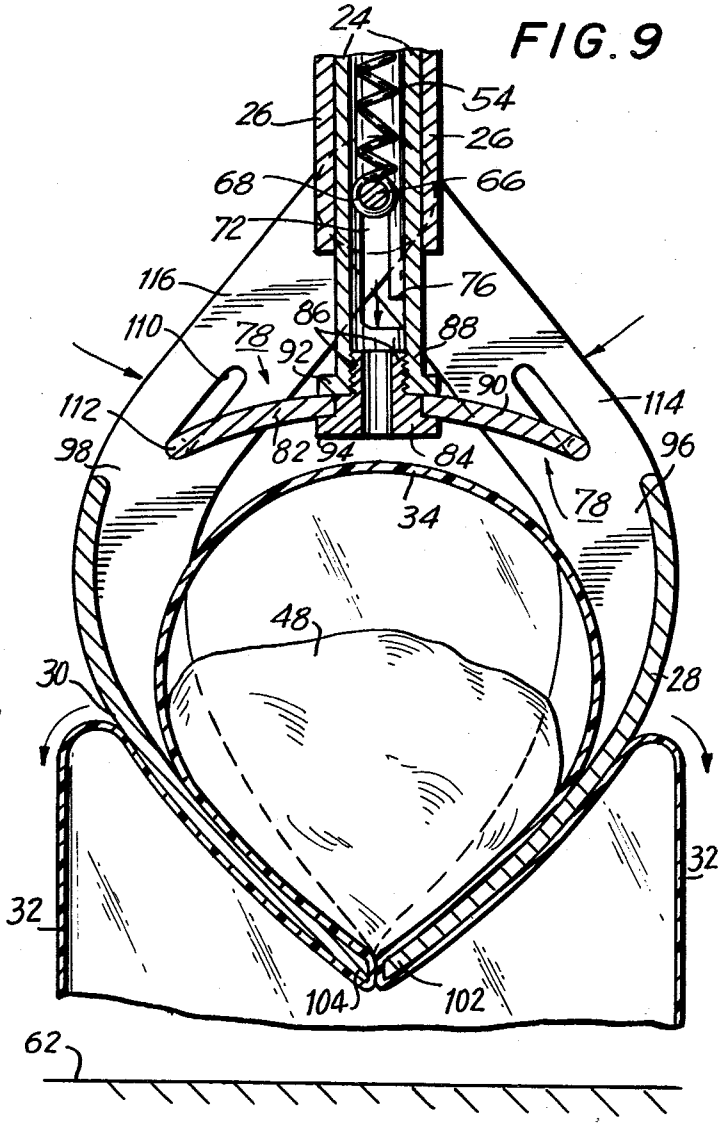
FIG. 9 is similar to FIG. 7 but shows the disposition of the scoop elements and appurtenances thereto with the scoop closed about the deposit of dog feces which is now with a bag.

The upper partially rotatable member 22 includes a hollow rectilinear leg 38 which is partially rotatable about its longitudinal axis, and a generally rectilinear handle 40 which extends generally transverse to the leg 38 and is attached to the terminal end 42 of the leg 38. The barrel 26 and the leg 38 are coaxially aligned in tandem, and the respective ends 44 of the barrel 26, and 46 of the leg 38, abut each other when the member 22 is partially rotated, so that an inner generally rectilinear resilient elastic member to be described infra displaces the member 22 towards the barrel 26 and into abutting relationship and the scoop members 28 and 30 close about a deposit 48 of dog feces or the like (FIG. 9).

Figure 3:
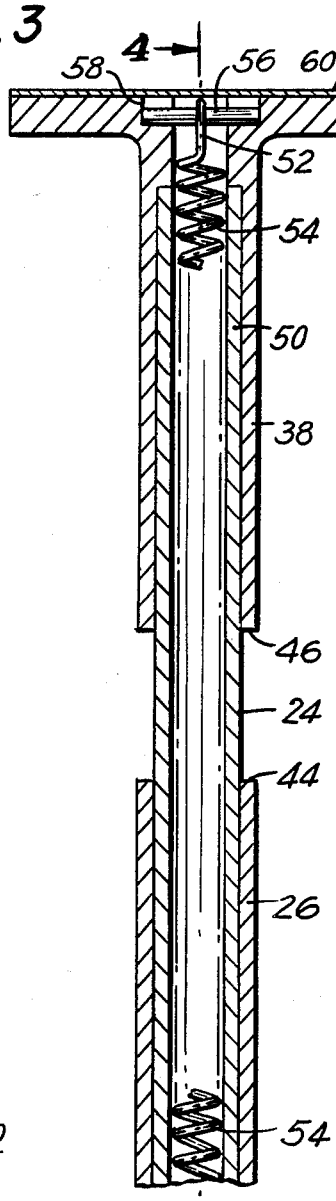
FIG. 3 is a sectional elevation view taken substantially along the line 3—3 of FIG. 2.
Figure 4:
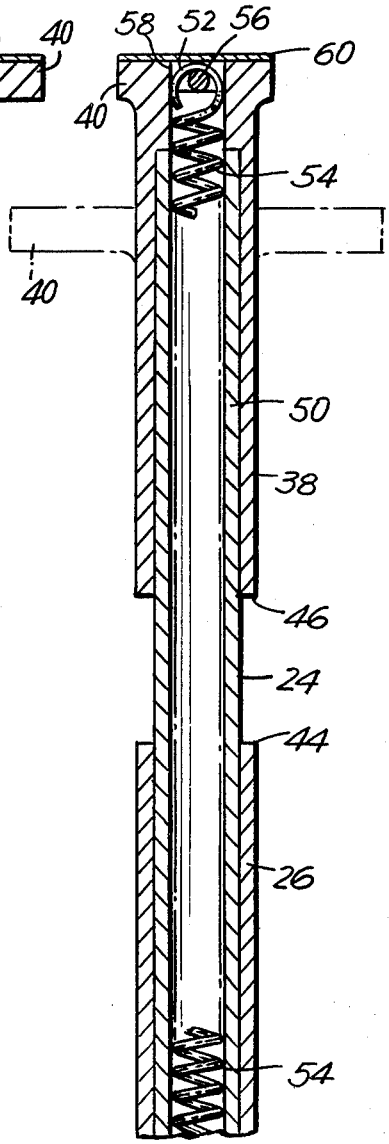
FIG. 4 is a sectional elevation view taken substantially along the line 4—4 of FIG. 3.

One end 50 of the sleeve 24 (FIGS. 3 and 4) is attached to the end 46 of the leg 38 which abuts the barrel 26, and as best seen in FIGS. 3 and 4, the sleeve 24 extends coaxially within the barrel 26 from the one end 50. FIGS. 3 and 4 also illustrate that the outer surface of the sleeve 24 is contiguous with the inner surface of the barrel 26, so that the sleeve 24 is slidably displaceable both longitudinally and partially rotatably within the barrel 26.

Figure 2:
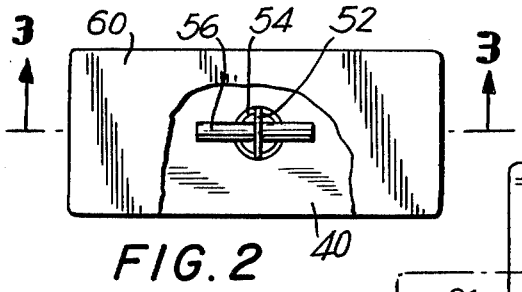
FIG. 2 is a plan view of the upper portion of the device.
Figure 5:
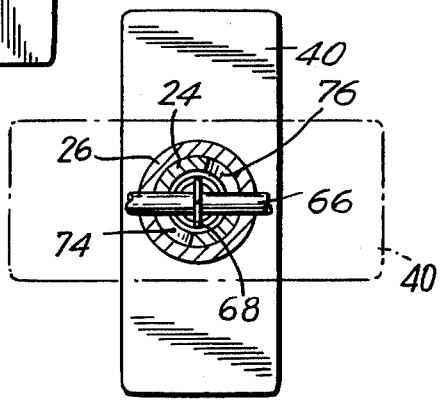
FIG. 5 is a bottom sectional plan view taken substantially along the line 5—5 of FIG. 6.

FIGS. 2, 3 and 4 show the preferred means for attaching an end 52 of a generally rectilinear resilient elastic member consisting in this case of a steel coil spring 54 to the handle 40. The end 52 is looped about pin 56 which is mounted to and extends across a central opening 58 in the handle 40. A length of tape 60 extends across the top of the handle 40 and covers the opening 58.

As mentioned supra, the handle 40 is displaceable downwards upon partial rotation, as shown in phantom outline in FIG. 4, so that the scoops 28 and 30 close about the deposit 48 of dog feces. This configuration of the scoops 28 and 30 is shown in FIG. 9, and this orientation of the device enables the displacement of the dog feces 48 from a surface 62 to take place by manually lifting the entire device plus dog feces 48 away from a surface 62 (FIG. 9). Thereafter, the open mouth end of the bag 32 is displaced downwards from juxtaposition with the scoops 28 and 30 and the bag 32 containing the dog feces 48 is subsequently closed, preferably by being self-knotted and tied shut via knot 64 (FIG. 10), after which the scoop arms 28 and 30 may again be spread apart as in FIGS. 1 and 7, by manual displacement of the member 22 away from the barrel 26 and concomitant partial rotation of the member 22, so that the feces-laden bag 32 may be entirely separated from the device for ultimate disposal. Thus a completely sanitary removal of the deposit 48 of dog feces from the surface 62 is accomplished.

Figure 7:
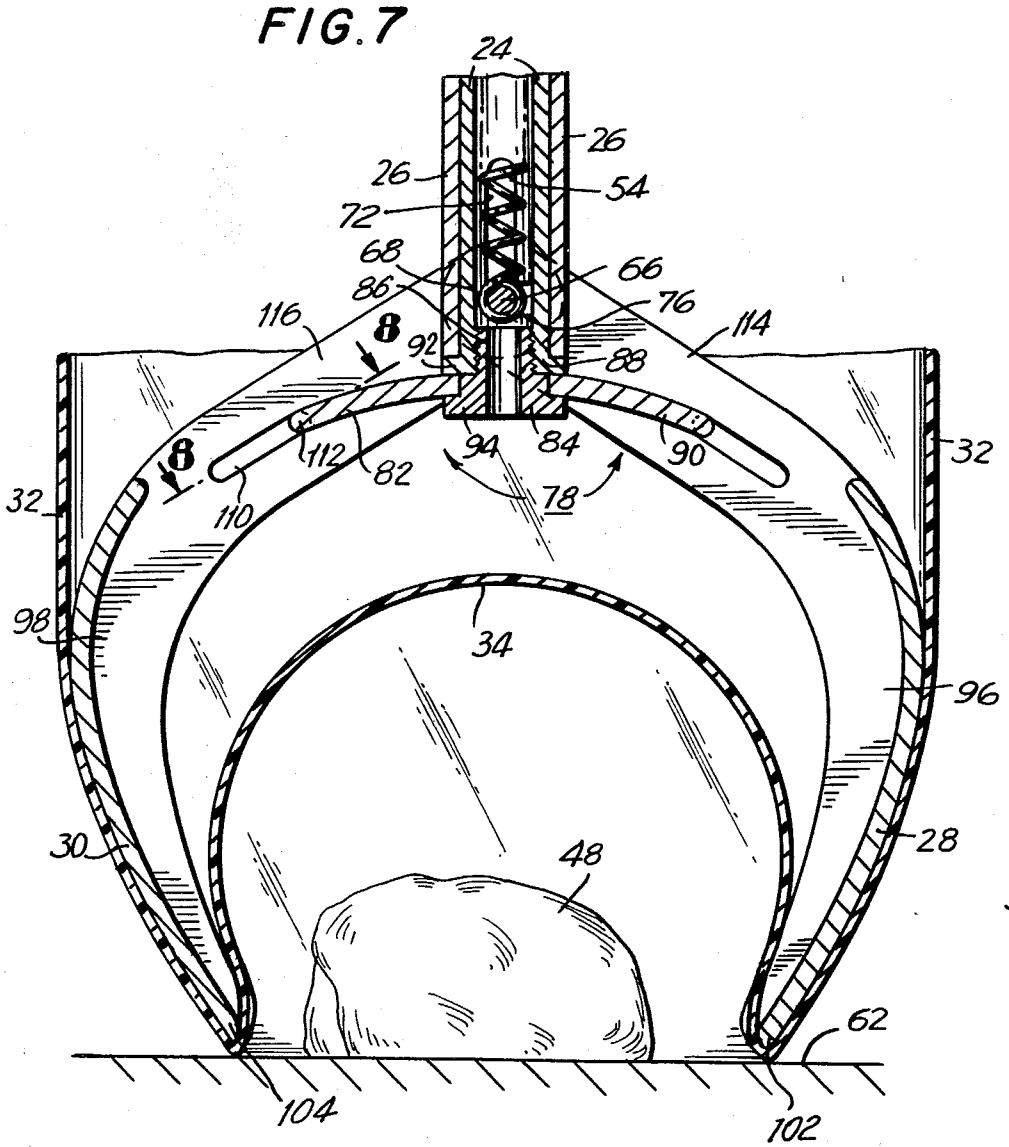
FIG. 7 is a partial sectional elevation view taken substantially along the line 7—7 of FIG. 6.

Referring now to the lower portion of the device 20 adjacent the scoops 28 and 30, an axle member 66 (FIGS. 6, 7 and 9), which is of a generally rectilinear configuration and which may in practice alternatively consist of a bolt or the like, is mounted to the barrel 26 adjacent the other end of the barrel 26. The axle 66, as best seen in FIG. 6, extends generally transversely through both the barrel 26 and the sleeve 24. As shown in FIGS. 6, 7 and 9, the other end of the sleeve 24 extends beyond the other end of the barrel 26.

The generally rectilinear resilient elastic member consisting in this case of the steel coil spring 54 extends within the sleeve 24 to a lower attachment, at one end 68 of the spring 54, to the axle 66. The attachment in this case, as best seen in FIGS. 7 and 9, consists of a looping of the one end 68 of the spring 54 about the axle 66 at generally the middle of the axle 66.

Referring now to the lower or other end of the sleeve 24, a pair of opposed longitudinal slots 70 and 72 are provided in the sleeve 24 adjacent its other end (see FIG. 6). The axle 66 extends through the slots 70 and 72. The lower end of each of the slots 70 and 72 (adjacent the other end or terminus of the sleeve 24), i.e. the end of each of the slots 70,72 which is juxtaposed with the other end of the sleeve 24, is provided with a respective lateral extension 74 and 76. Thus, sleeve 24 retention recesses are defined by the lateral extensions 74 and 76. The axle 66 extends into the recesses 74, 76 when the elastic member (spring 54) is elongated (FIGS. 1,3,4,6 and 7) by manipulation and manual longitudinal displacement of the upper partially rotatable member 22 away from the barrel 26 and subsequent partial rotation (or a concomitant urging towards partial rotation) of the partially rotatable member 22, with concomitant partial rotation of the sleeve 24. Thus, and in this disposition of the several members, the scoops 28 and 30 are displaced away from each other and held semi-permanently in the open position, unless and until such time as the partially rotatable member is manually partially rotated in the opposite direction and released, at which time the spring 54, which is elongated and under stress, urges the sleeve 24 upwards with axle 66 sliding upwards through slots 70, 72, with concomitant coverging and snapping shut of the scoops 28, 30 about the deposit 48 of dog feces, as will appear infra, so that the FIG. 9 disposition of the scoops 28 and 30 is attained.

With further regard to the lower scoop end of the device 20, as shown in FIG. 6, a generally rectangular and generally planar horizontal baffle 78, which in this embodiment of the invention has a central rectilinear peak or ridge 80 from which two opposed generally planar rectangular portions, such as 82, depend downwards at a slight acute angle to the horizontal, is centrally mounted to the lower or other end of the sleeve 24 by means of a threaded coupling 84. The outer threads of the coupling 84 are screwed or meshed into inner threads at the lower end of the sleeve 24, with the threaded coupling end 86 being the male portion and the threaded lower end 88 of the sleeve 24 being the female portion of the threaded joint. Thus, the sleeve 24 is generally perpendicular to the generally planar baffle 78. The FIGS. 7 and 9 show cross-sectional configuration of the baffle 78, which has the two opposed portions 82 and 90. FIGS. 6, 7 and 9 also show the mounting of the baffle 78 between circular lips 92 and 94 of, respectively, the lower end 88 of the sleeve 24 and the lower end of the coupling 84. The main purpose for the provision of the baffle 78 is to restrain the bottom portion 34 of the bag 32, and to prevent inadvertent puncturing of the bag 32, especially the middle of the bottom portion 34, by movement or action of the lower end 88 of the sleeve 24 against the mounted bag 32, especially during the initial manipulation of the bag 32 to mount the empty bag 32 on the device 20 when the scoops 28 and 30 are spaced apart as in FIGS. 1 and 7.

The scoops 28 and 30 are each mounted to the device 20 by means of a pair of opposed lateral means, consisting in this embodiment of the invention of opposed curved levers, with each scoop 28 or 30 having a laterally attached lever along each side edge. Thus, the scoop 28 is mounted to the device 20 on lever 96 and another opposed lever 97, partially shown in FIG. 6, and the scoop 30 is mounted to the device 20 on levers 98 and 100. The levers 96, 97, 98, 100, or other functionally equivalent lateral mounting means, mount each of the scoops 28, 30 to both adjacent corners of the planar baffle 78, and pivotally to the ends of the axle 66, so that, as will appear infra, when the upper partially rotatable member 22 is displaced away from the barrel 26, the lower free ends 102 and 104 (FIGS. 7 and 9) of the respective scoops 28 and 30 are retracted away from each other (FIGS. 1 and 7). In this disposition of the several elements, the deformable open-mouthed bag 32 is mountable on the scoops 28 and 30 with the bottom 34 of the bag 32 adjacent the planar baffle 78, so that when the barrel 26 and the leg 38 of the partially rotatable member 22 are abutting, the free ends 102, 104 of the respective scoops 28 and 30 are juxtaposed, as shown in FIG. 9.

As mentioned supra, each scoop 28, 30 has a laterally attached curved lever along each side edge, so that a portion of each lever is integral with its respective scoop 28 or 30. The balance of each lever extends to an upper pivotal mounting at an end of the axle 66, as best shown in FIG. 6, with one end 106 of the axle 66 extending through upper end mounting holes in the levers 96 and 98, and the other end 108 of the axle 66 extending through upper end mounting holes in the levers 97 and 100, so that the levers and associated scoops are pivotally mounted to the axle 66.

Each lever is slotted adjacent its respective scoop, e.g. the lever 98 is provided with a slot 110 (FIGS. 7 and 9) adjacent to scoop 30, and a protuberance extends from each of the adjacent corners of the baffle 78 into the respective slot in a lever, e.g. a protuberance 112 extends from a corner of the portion 82 of the generally planar baffle 78 into the slot 110, so that the travel of the scoop 30 is guided. Finally, in the present exemplary preferred embodiment and as shown in FIGS. 1, 7 and 9, the upper portions 114, 116 of the respective levers 96, 98, between the slot (such as 110 in the lever 98), and the pivotal mounting of the upper end of each lever to an end of the axle 66, are generally rectilinear. This consideration applies equally to the levers 97 and 100.

FIG. 11 shows an alternative embodiment of the invention, in which the generally rectilinear resilient elastic member consists of an elastomeric rubber band 118, the lower end of which is looped about the axle 66, while the upper end of the rubber band 118 is looped about the pin 56.

As mentioned supra, the various structural members of the device 20, to the exclusion of the elastic member, may be composed of paperboard, plastic, sheet metal, wood, or the like. It is preferred that these various structural members be composed of white or colored plastic, to emphasize cleanliness and for its high visibility.

One further aspect of the result accomplished by the present invention is pertinent and should be mentioned. It is well known that flies, such as the common housefly, the bluetailed fly and the horsefly, exhibit a natural predilection, a certain propensity and an unfortunate proclivity to swarm about, light on, and crawl over deposited dog feces. Flies are naturally attracted and drawn to deposited dog feces for several reasons, inter alia, the natural biological urge to deposit eggs which mature into maggots on the dog feces.

In any event, flies also endeavor to gain access to the premises of humans, wherein they proceed to land on and crawl over food, personal possessions and property such as kitchen utensils, and even to crawl on and bite human beings, especially small children, toddlers and infants. Thus, the flies tend to communicate and spread disease, and to soil the interiors of dwellings, by the transmission of bacteria and dog feces per se from the dog droppings external to the home into the presence of humans in homes and apartments, principally because the legs of flies terminate with porous and moist feet, to which dog feces naturally tends to cling. The present sanitary dog litter bagger clearly functions to preclude such unhealthy and unsanitary spread of dog feces and disease into the lives of humans, by eliminating the deposited dog feces from sidewalks, curbs, streets, parks, etc. in urban areas and suburban areas.

It thus will be seen that there is provided a sanitary dog litter bagger which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A sanitary manual scoop and dog litter bagger comprising a hollow rectilinear barrel, a partially rotatable member, said partially rotatable member being mounted at one end of said barrel, said partially rotatable member having a hollow rectilinear leg and a handle, said hollow rectilinear leg being partially rotatable about its longitudinal axis, said handle extending substantially transverse to said leg and being attached to the terminal end of said leg, said barrel and said leg being coaxially aligned in tandem and abutting, a sleeve, one end of said sleeve being attached to the end of said leg which abuts said barrel and extending coaxially within said barrel, the outer surface of said sleeve being contiguous with the inner surface of said barrel, so that said sleeve is slidably displaceable both longitudinally and partially rotatably within said barrel, an axle, said axle being mounted to said barrel adjacent the other end of said barrel and extending substantially transversely through said barrel and said sleeve, the other end of said sleeve extending beyond the other end of said barrel, a substantially rectilinear resilient elastic member, said elastic member extending within said sleeve and said leg, means attaching one end of said elastic member to said axle, means attaching the other end of said elastic member to said handle, said sleeve having a pair of opposed longitudinal slots adjacent its other end, said axle extending through said slots, the end of each of said slots which is juxtaposed with the other end of said sleeve having a lateral extension, so that sleeve retention recesses are defined by said lateral extensions, said axle extending into said recesses when said elastic member is elongated by longitudinal displacement of said partially rotatable member away from said barrel and subsequent partial rotation of said partially rotatable member, with concomitant partial rotation of said sleeve, a rectangular planar baffle, said planar baffle being centrally mounted to the other end of said sleeve so that said sleeve is substantially perpendicular to said planar baffle, a pair of opposed scoops, and opposed lateral means mounting each of said scoops to both adjacent corners of said planar baffle and pivotally to the ends of said axle, so that when said partially rotatable member is displaced away from said barrel, the free ends of said scoops are retracted away from each other, a deformable open-mouthed bag being mountable on said scoops with the bottom of said bag adjacent said planar baffle, so that when said barrel and the leg of said partially rotatable member are abutting, the free ends of said scoops are juxtaposed.

2. The sanitary manual scoop and dog litter bagger of claim 1 in which the barrel and the sleeve are cylindrical, and the barrel is concentrically disposed about the sleeve.

3. The sanitary manual scoop and dog litter bagger of claim 1 in which the handle is rectilinear.

4. The sanitary manual scoop and dog litter bagger of claim 1 in which the elastic member is a spring.

5. The sanitary manual scoop and dog litter bagger of claim 1 in which the elastic member is an elastomeric rubber band.

6. The sanitary manual scoop and dog litter bagger of claim 1 in which the means attaching the one end of said elastic member to said axle comprises a looping of the one end of said elastic member about said axle at substantially the middle of said axle.

7. The sanitary manual scoop and dog litter bagger of claim 1 in which the means attaching the other end of said elastic member to said handle comprises a pin, said handle having a central opening, said pin being mounted to said handle across said opening, together with a looping of the other end of said elastic member about said pin.

8. The sanitary manual scoop and dog litter bagger of claim 1 in which the lateral means mounting each of the scoops to the adjacent corners of the planar baffle and pivotally to the ends of the axle comprises opposed curved levers, each scoop having a laterally attached lever along each side edge, so that a portion of each lever is integral with its respective scoop, the balance of each lever extending to the pivotal mounting to an end of the axle and being slotted adjacent its respective scoop, a protuberance extending from each of the adjacent corners of the planar baffle into the respective slot in a lever.

9. The sanitary manual scoop and dog litter bagger of claim 8 in which the portion of each lever between the slot in the lever and the pivotal mounting of the end of the lever to the end of the axle is substantially rectilinear.

* * * * *